US005121786A

United States Patent [19]

Kawase et al.

[11] Patent Number: 5,121,786

[45] Date of Patent: Jun. 16, 1992

[54] PROCESS FOR MANUFACTURING SIAMESE-TYPE CYLINDER BLOCK

[75] Inventors: Akio Kawase, Ageo; Shuji Kobayashi, Kawagoe; Toshio Hamashima, Sakado; Kiyoshi Shibata, Hidaka; Yoshikazu Kanzawa, Tsurugashima; Masuo Ebisawa, Kawagoe; Shigeo Kaiho, Oomiya, all of Japan

[73] Assignee: Honda Giken Kogyo Kabushiki Kaisha, Tokyo, Japan

[21] Appl. No.: 51,622

[22] Filed: May 19, 1987

Related U.S. Application Data

[62] Division of Ser. No. 795,644, Nov. 6, 1985, abandoned.

[51] Int. Cl.[5] ..... B22D 17/00; B22D 19/00; B22D 25/00

[52] U.S. Cl. ..... 164/98; 164/108

[58] Field of Search ..... 164/98, 103, 107, 108; 148/3

[56] References Cited

U.S. PATENT DOCUMENTS

| | | | |
|---|---|---|---|
| 3,130,461 | 4/1964 | Curtis | 164/108 |
| 3,807,012 | 4/1974 | Logvist | 164/103 |
| 3,977,459 | 8/1976 | Bonitz | 164/98 |
| 4,003,422 | 1/1977 | Schramm et al. | 164/98 |
| 4,336,076 | 6/1982 | Edamura et al. | 148/3 |
| 4,411,709 | 10/1983 | Nakanishi | 148/3 |
| 4,420,345 | 12/1983 | Ito et al. | 148/3 |

FOREIGN PATENT DOCUMENTS

| | | | |
|---|---|---|---|
| 133518 | 11/1978 | Japan | 148/3 |
| 1258 | 1/1981 | Japan | 164/103 |
| 11762 | 1/1982 | Japan | 164/103 |
| 68260 | 4/1982 | Japan | 164/103 |
| 112649 | 7/1983 | Japan | 164/103 |
| 147763 | 8/1984 | Japan | 148/3 |

*Primary Examiner*—Samuel M. Heinrich
*Attorney, Agent, or Firm*—Julian Cohen

[57] ABSTRACT

A process for manufacturing a siamese-type clyinder block which is disclosed herein comprises a blank making step of providing a cylinder block blank in which a sleeve made of a cast iron is cast in each cylinder barrel of a siamese-type barrel made of an aluminum alloy and consisting of a plurality of cylinder barrels connected in series, and a mechanically working or machining step of forming the inner peripheral surface of each sleeve of the cylinder block blank into a true circle. The process is characterized in that the blank making step includes placing highly rigid sleeves each having a thickness set as large as 10% or more of the inner diameter thereof into a siamese-type cylinder barrel molding cavity in a mold and then pouring a molten metal of aluminum alloy under a pressure into the cavity to effect a casting. The sleeve is cast-in as it is at an ambient temperature or in a heated state. A cylinder block blank resulting from the casting-in of sleeves at an ambient temperature is subjected to a thermal treatment for reducing the casting strain in each cylinder barrel.

23 Claims, 17 Drawing Sheets

PROCESS FOR MANUFACTURING SIAMESE-TYPE CYLINDER BLOCK

This is a divisional on application Ser. No. 795,644 filed Nov. 6, 1985, now abandoned.

BACKGROUND OF THE INVENTION

1. Field of the Invention

The present invention relates to a process for manufacturing a siamese-type cylinder block and more particularly, to such a process comprising a blank making step of providing a cylinder block blank in which a sleeve made of a cast iron is incorporated cast in each cylinder barrel of a siamese-type cylinder barrel made of an aluminum alloy and consisting of a plurality of cylinder barrels connected in series, and a mechanical working or machining step of forming the inner peripheral surface of each sleeve of the resulting cylinder block blank into a true circle.

2. Description of the Prior Art

Such conventional blank making steps include placing sleeves in a siamese-type cylinder barrel molding cavity in a mold and then, pouring a molten metal of aluminum alloy under pressure into the cavity for casting. Thereby, a casting strain is produced in the cylinder barrels in the blank due to the casting pressure and the action of rapid solidification of the aluminum alloy. With a sleeve having a smaller thickness and a lower rigidity, such a casting strain influences the sleeve to produce a strain therein. To avoid this, the thickness of the sleeve may be increased, but with a too large thickness, the amount of sleeve to be cut is increased in subsequent working into a true circle, which is uneconomical and causes an increase in working time. Even if the thickeness of the sleeve is increased, there are the following problems which arise with a cylinder block resulting from the immediately working of the inner peripheral surface of the sleeve into a true circle after the casting of the blank. In the operation of an engine assembled using such cylinder block, the casting strain in the cylinder barrel influences the sleeve when the cylinder barrel heated during the operation has been returned to an ambient temperature after the stoppage of operation of the engine, thereby causing the amount of permanent deformation of the inner diameter at the sleeve to increase. Thus, a clearance is produced between a piston ring and the sleeve resulting in an increased amount of blow-by gas and a useless consumption of oil.

When the sleeve has increased thickness at an ambient temperature, the heat of molten metal is absorbed by the sleeve so that the molten metal close to the sleeve is solidified earier than the molten metal close to a breakable core for forming a water jacket. Consequently, the metal structure in the cylinder barrel is different from that at the portion close to the core. In this case, both the metal structures around the sleeves vary in thickness in the radial direction of the sleeve, and because the region between the adjacent sleeves is not occupied by the core, the metal structure between the adjacent sleeves is different from both the above metal structures. In addition to the problem in metal structure, because the shrinkage of the sleeve heated by the molten metal dose not follow the solidification shrinkage of the molten metal, the casting stress remaining the sleeve is not uniform around the circumference of the sleeve.

The absorption of the heat of the molten metal by the sleeve causes the early solidification of the molten metal to degrade the close adhesion between the sleeve and the molten metal, thereby producing a very small clearance between the sleeve and the cylinder barrel resulting in a poor release of heat of from the sleeve.

Thus, if the casting stress remaining in the sleeve is not uniform around the circumference from the sleeve the release of heat of the sleeve is poor, and in the operation of an engine assembled using a cylinder block obtained through the working of the inner peripheral surface of such sleeve into a true circle, the amount of sleeve thermally expanded is ununiform around the circumference of the sleeve, causing a clearance to be produced between a piston ring and the sleeve, resulting in the same problems as described above.

In providing a blank as described above and including a water jacket to which the entire periphery of a siamese-type cylinder barrel faces, operations which have been adopted include placing sleeves and a water-jacket shaping breakable core surrounding the sleeves into a siamese-type cylinder barrel molding cavity in a mold and then, pouring a molten metal of aluminum alloy into the cavity to cast a blank, removing unnecessary portions such as gates and runners from the blank and then, breaking the breakable core to remove about half thereof by applying vibration to the blank, and heating the blank for a period of about 4 hours at a temperature of 350° C. or more to burn a binder contained in the core and enhance the breakability of the remainder of the core. In the above heating step, the heating causes the hardness of the aluminum alloy portion in the blank to be considerably reduced and make it impossible for a cylinder head-bound surface, a crank journal bearing holder, an oil pan-bound surface of a crankcase or the like to retain a satisfactory hardness. Therefore, the heating step has been followed by an operation comprising subjecting the blank to a T6 treatment, namely to a thermal treatment of heating the blank for a period of about 2 hours at a temperature of about 500° C. and then cooling it with water to provide the recovery of the hardness, a step of breaking the remainder of the core to remove it from the blank by applying vibration to the blank, subjecting the blank to cleaning fettling and checking the resulting blank.

However, the above conventional process is accompanied by a problem that even if the T6 treatment enables the hardness of the aluminum alloy portion in the blank to be improved, a non-uniform stress remains in the sleeve at the cooling step in the above treatment and thus, a high performance cylinder block can not be obtained.

The conventional process also has the disadvantage of uneconomically increased amount of energy consumed due to two heating steps included therein.

SUMMARY OF THE INVENTION

It is therefore an object of the present invention to provide a process for manufacturing a siamese-type cylinder block wherein using a highly rigid sleeve having a specific thickness, a siamese-type cylinder block of an improved economy can be obtained with a reduced influence of the casting strain in a cylinder barrel on the sleeve and with a decreased amount of sleeve cut at to machine the inner peripheral surface of the sleeve into a true circle.

It is another object of the present invention to provide a process for manufacturing a siamese-type cylinder barrel wherein using a highly rigid sleeve having a specific thickness, a siamese-type cylinder block can be produced with a reduced influence of the casting strain in a cylinder barrel on the sleeve and with the casting strain in the cylinder barrel being diminished by a thermal treatment, thereby to substantially reduce the amount of permanent deformation of each sleeve in its inner diameter.

Further, it is an object of the present invention to provide a process for manufacturing a siamese-type cylinder block wherein using a highly rigid sleeve having a specific thickness, a siamese-type cylinder block can be obtained with a reduced influence of the casting strain in a cylinder barrel on the sleeve and with the casting stress remaining in the sleeve being made substantially uniform around the circumference of the sleeve while the release of heat of the sleeve is improved by heating the sleeve to a predetermined temperature to castingly incorporate it, so that the amount of each sleeve thermally expanded may be substantially uniform around the circumference of the sleeve during the operation of the engine.

Still further, an object of the present invention is to provide a process for manufacturing a siamese-type cylinder block wherein a water-jacket shaping breakable core is removed at ambient temperature and a thermal treatment is conducted to an extent such that strain relieving may be achieved, thus economically producing a high performance siamese-type cylinder block.

To accomplish the above objects, according to the present invention, there is provided a process for manufacturing a siamese-type cylinder block, comprising a blank making step of providing a cylinder block blank in which a sleeve made of a cast iron is incorporated in each cylinder barrel of a siamese-type cylinder barrel made of an aluminum alloy and consisting of a plurality of cylinder barrels connected in series, and a mechanically working or machining step of forming the inner peripheral surface of each sleeve of the resulting cylinder block blank into a true circle, wherein the blank making step includes placing highly rigid sleeves each having a thickness of 10% or more of the inner diameter thereof into a siamese-type cylinder barrel molding cavity in a mold and then pouring a molten metal of aluminum alloy under a pressure into the cavity to effect a casting.

According to the present invention, there is also provided a process for manufacturing a siamese-type cylinder block, comprising a blank making step of providing a cylinder block blank in which a sleeve made of a cast iron is incorporated in each cylinder barrel of a siamese-type cylinder barrel made of an aluminum alloy and consisting of a plurality of cylinder barrels connected in series, and a mechanically working or machining step of forming the inner peripheral surface of each sleeve of the resulting cylinder block blank into a true circle, wherein the blank making step includes placing highly rigid sleeves each having a thickness of 10% or more of the inner diameter thereof into a siamese-type cylinder barrel molding cavity in a mold and then pouring a molten metal of aluminum alloy under a pressure into the cavity to cast a cylinder block blank, and subjecting the cylinder block blank to a thermal treatment to reduce the casting strain produced in the cylinder barrel.

Further, according to the present invention, there is provided a process for manufacturing a siamese-type cylinder block, comprising a blank making step of providing a cylinder block blank in which a sleeve made of a incorporated iron is cast in each cylinder barrel of a siamese-type cylinder barrel made of an aluminum alloy and consisting of a plurality of cylinder barrels connected in series, and a mechanically working or machining step of forming the inner peripheral surface of each sleeve of the resulting cylinder block blank into a true circle, wherein the blank making step includes heating highly rigid sleeves each having a thickness of 10% or more of the inner diameter thereof to a temperature of 150° to 700° C. thereafter placing them in a siamese-type cylinder barrel molding cavity in a mold and then pouring a molten metal of aluminum alloy under a pressure into the cavity to effect a casting.

Yet further, according to the present invention, there is provided a process for manufacturing a siamese-type cylinder block, comprising a blank making step of providing a cylinder block blank in which a sleeve made of a cast iron is incorporated in each cylinder barrel of a siamese-type cylinder barrel made of an aluminum alloy and consisting of a plurality of cylinder barrels connected in series and which includes a water-jacket faced by the entire periphery of the siamese-type cylinder barrel, and a mechanical working or machining step of forming the inner peripheral surface of each sleeve of the resulting cylinder block blank into a true circle, wherein the blank making step includes placing the sleeves and a water-jacket shaping breakable core surrounding the sleeves in a siamese-type cylinder barrel molding cavity in a mold and then pouring a molten metal of aluminum alloy into the cavity to cast a cylinder block blank, breaking the core at an ambient temperature to remove it from the cylinder block blank, and subjecting the cylinder block blank to annealing.

According to the procedure of the above process, a highly rigid sleeve having a thickness of 10% or more of the inner diameter thereof is castingly incorporated in each cylinder barrel and therefore, the influence of the casting strain in the cylinder barrel can be diminished on the sleeve and moreover, the amount of sleeve cut can be reduced when working of the inner peripheral surface of the sleeve into a true circle to improve economy.

While the casting incorporation of each thick and highly rigid sleeve having a thickness of 10% or more of the inner diameter thereof in each cylunder barrel results in a diminished influence of the casting strain in the cylinder barrel on the sleeve, the cylinder block blank is then subjected to a thermal treatment to reduce the casting strain in the cylinder barrel and thereafter, the inner peripheral surface of the sleeve is worked into a true circle, so that even if the sleeve is consequently of a smaller thickness and a lower rigidity, the reduction of the casting strain in each cylinder barrel enable the influence of such casting strain to be substantially eliminated.

Therefore, in the operation of an engine assembled using such a cylinder block, the amount of permanent deformation of each sleeve in inner diameter is very small and hence, a clearance is suppressed to the utmost from being produced between a piston ring and the sleeve, thus making it possible to overcome problems of an increase in amount of blow-by gas and a useless consumption of oil.

In addition, since the influence of the casting strain in each cylinder barrel is reduced on each sleeve, it is possible to place the adjacent sleeves maximally close to each other, whereby the cylinder block and thus, the entire engine can be small-sized to achieve a lightweight.

Further, each thick and highly rigid sleeve having a thickness of 10% or more of the inner diameter thereof is heated to a temperature of 150° to 700° C. and castingly incorporated in each cylinder barrel and hence, the influence of the casting strain in the cylinder barrel on the sleeve is reduced, while the casting stress remaining in the sleeve is substantially uniform around the circumference of the sleeve and further, the release of heat of the sleeve is good. In the operation of an engine assembled using such a cylinder block, the amount of each sleeve thermally expanded is substantially uniform around the circumference of the sleeve and thus, clearance can be to minimized between the piston ring and the sleeve as in the case described above.

In addition, because the influence of the casting strain in each cylinder barrel on each sleeve is smaller and the casting stress remaining in the sleeve is substantially uniform around the circumference of the sleeve, it is possible to place the adjacent sleeves as close to each other as possible as in the case described above.

Further, since the water-jacket shaping core is broken at ambient temperature and removed from the cylinder block blank, the hardness of the blank can not be reduced. Thereupon, a T6 treatment is not required for recovering the hardness of the blank and thus, a high performance cylinder block can be provided by merely subjecting the blank to an annealing treatment for strain relief.

Any thermal treatment is also not required for removing the core, and the above annealing treatment is conducted in a shorter time at a relatively low temperature, thus making it possible to substantially reduce energy consumption and improve an economy.

BRIEF DESCRIPTION OF THE DRAWINGS

The above and other objects, features and advantages of the invention will become apparent from reading the following description taken in conjunction with the accompanying drawings in which:

FIG. 1 is a perspective view of the apparatus from above;

FIG. 2 is a sectional view taken along line II—II in FIG. 1;

FIG. 3 is a perspective view of the apparatus, from below;

FIG. 4 is a sectional view taken along line IV—IV in FIG. 2;

DESCRIPTION OF PREFERRED EMBODIMENTS

Figure 1:
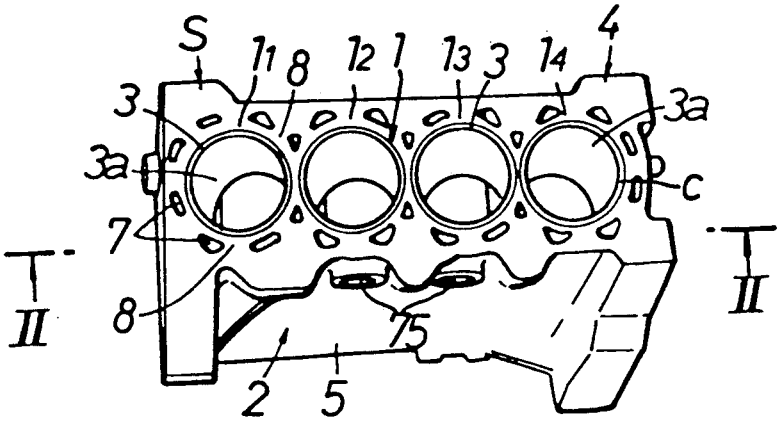
FIGS. 1 to 4 illustrate an in-line siamese-type cylinder block provided according to the present invention.
Figure 2:
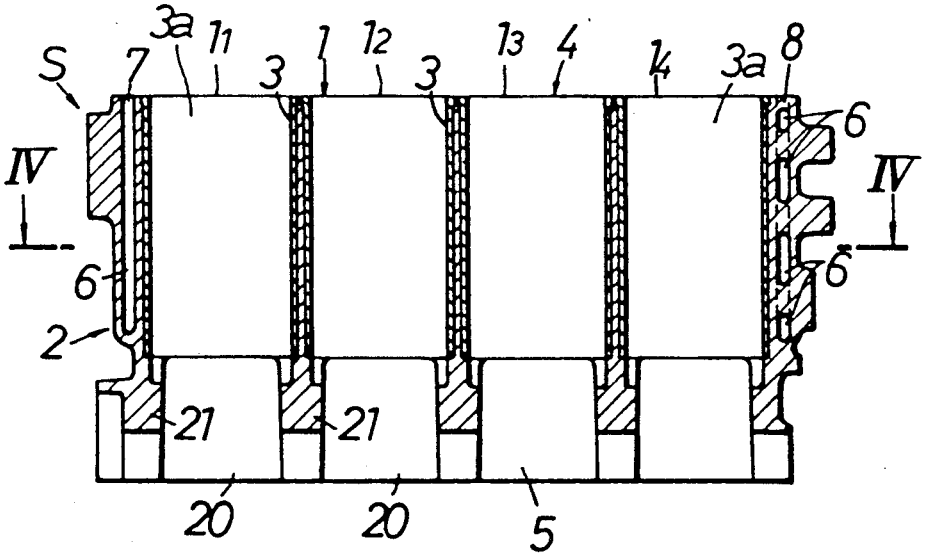

Referring to FIGS. 1 to 4, therein is shown a in-line siamese-type cylinder block S obtained according to the present invention. The cylinder block S is comprised of a cylinder block body 2 made of an aluminum alloy and a sleeve 3 made of a cast iron and cast in the body 2. The cylinder block body 2 is constituted of a siamese-type cylinder barrel 1 consisting of a plurality of, e.g., four (in the illustrated embodiment) cylinder barrels $1_1$ to $1_4$ connected to one another in series, an outer wall 4 surrounding the siamese-type cylinder barrel 1, and a crankcase 5 connected to the lower edges of the outer wall 4. The sleeve 3 is cast in each the cylinder barrels $1_1$ to $1_4$ to define a cylinder bore 3*a*.

A water jacket 6 is defined between the siamese-type cylinder barrel 1 and the outer wall 4, so that the entire periphery of the siamese-type cylinder barrel 1 faces the water jacket 6. At the opening on the cylinder head binding side at the water jacket 6, the siamese-type cylinder barrel 1 is connected with the outer wall 4 by a plurality of reinforcing deck portions 8, and the space between the adjacent reinforcing deck portions 8 functions as a communication port 7 into a cylinder head. Thereupon, the cylinder block S is constituted into a closed deck type.

Figure 5:
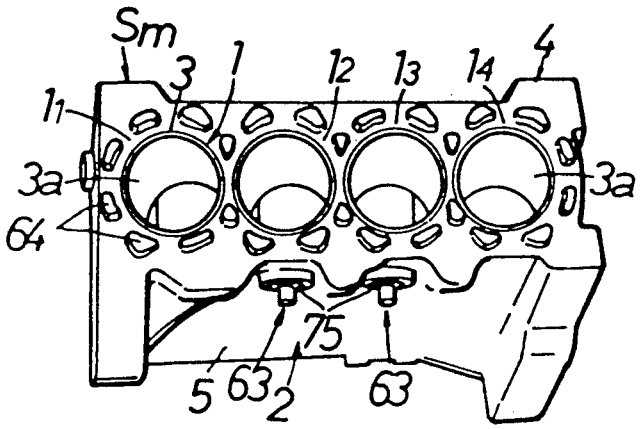
FIG. 5 is a perspective view of a siamese-type cylinder block blank produced in a casting process according to the present invention, viewed from above.
Figure 3:
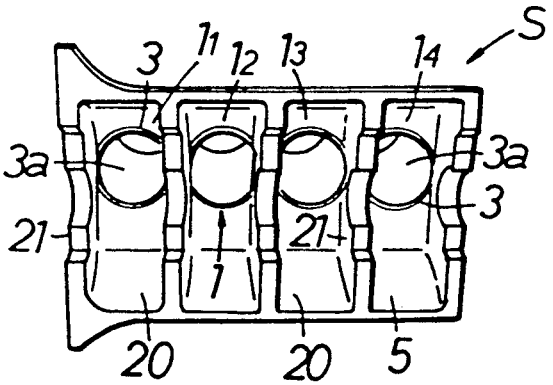
Figure 4:
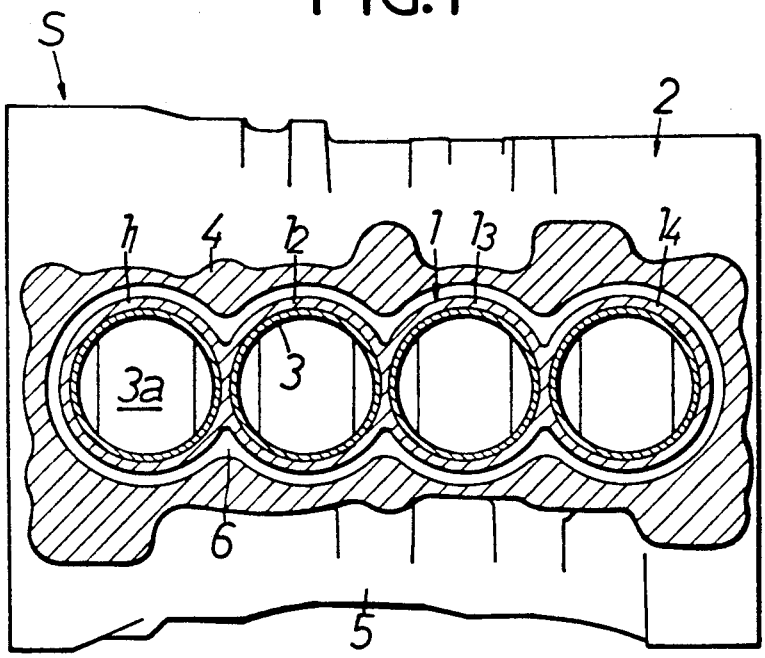

FIG. 5 illustrates a cylinder block blank Sm produced by the casting, and a sleeve in this blank Sm has a inner diameter of 78 mm and a thickness of 10% or more of the inner diameter thereof, for example, of 8 mm.

FIGS. 6 to 10 illustrate an apparatus for casting a cylinder block blank Sm, which apparatus comprises a mold M. The mold M is constituted of a liftable upper die 9, first and second laterally split side dies $10_1$ and $10_2$ (see FIGS. 6 and 7) disposed under the upper die 9, and a lower die 11 on which both the side dies $10_1$ and $10_2$ are slidably laid.

Figure 7:
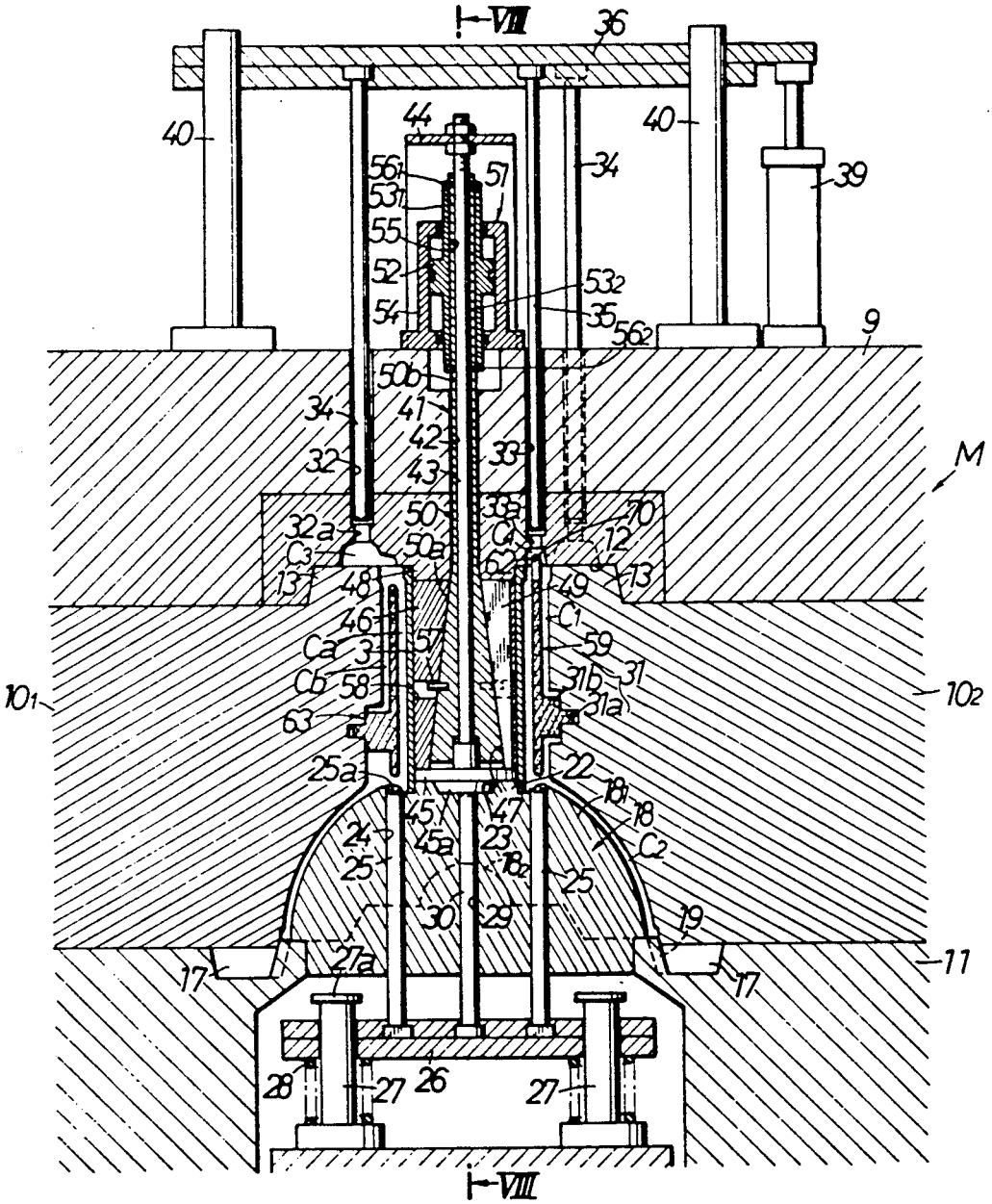
FIG. 7 is a front view in vertical section of the casting apparatus with the mold closed.

A clamping recess 12 is provided at the underside of the upper die 9 to define the upper surface of a first cavity C1, and a clamping projection 13 adapted to be fitted in the recess 12 is provided on each the side dies $10_1$ and $10_2$. The first cavity C1 consists of a siamese-type cylinder barrel molding cavity Ca defined between a water-jacket molding sand core 59 as a breakable core and an expansion shell 46, and an outer wall molding cavity Cb defined between the sand core 59 and both the side dies $10_1$ and $10_2$, in the clamped condition as shown in FIG. 7.

Figure 8:
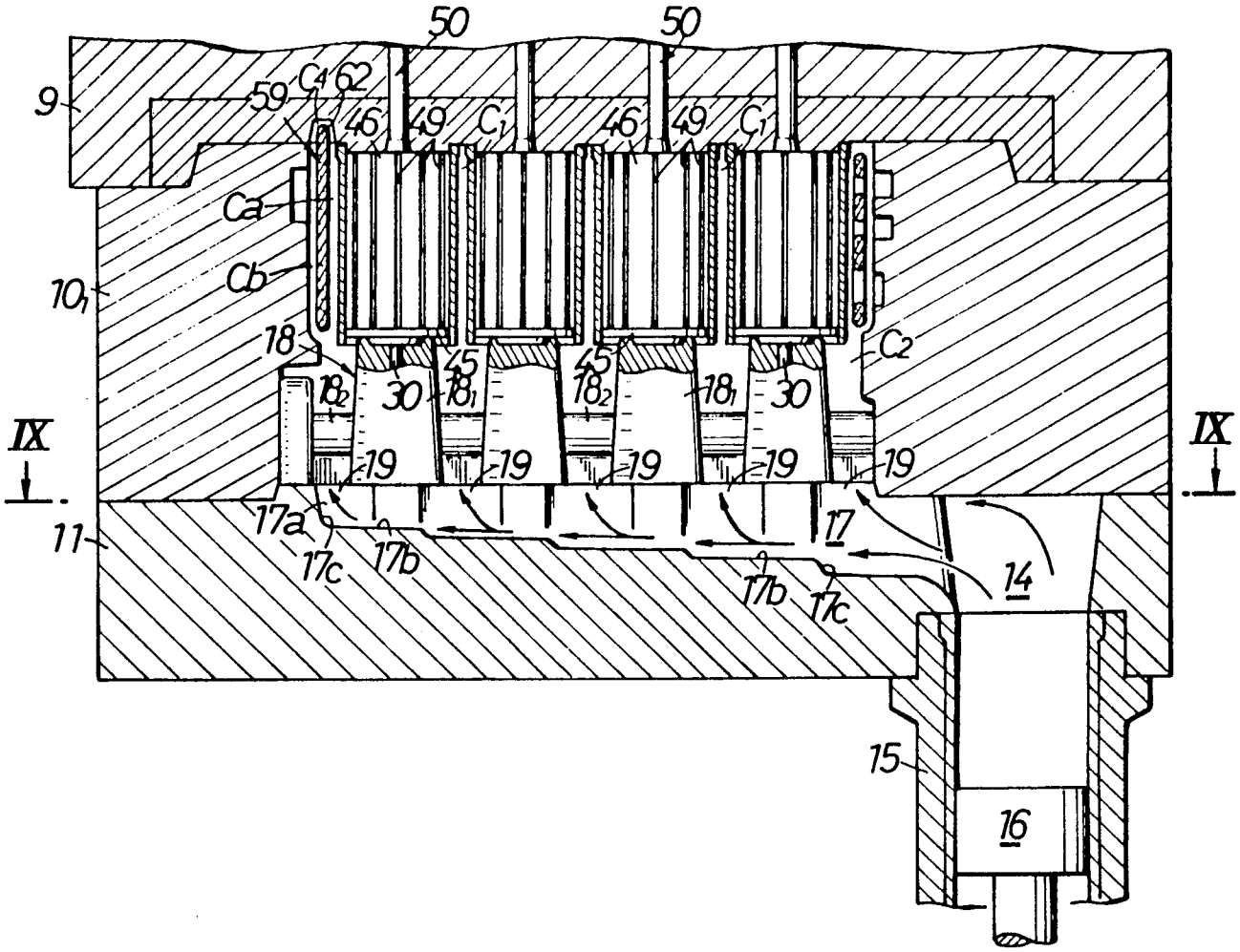
FIGS. 8 is a sectional view taken along line VIII—VIII in FIG. 7.
Figure 9:
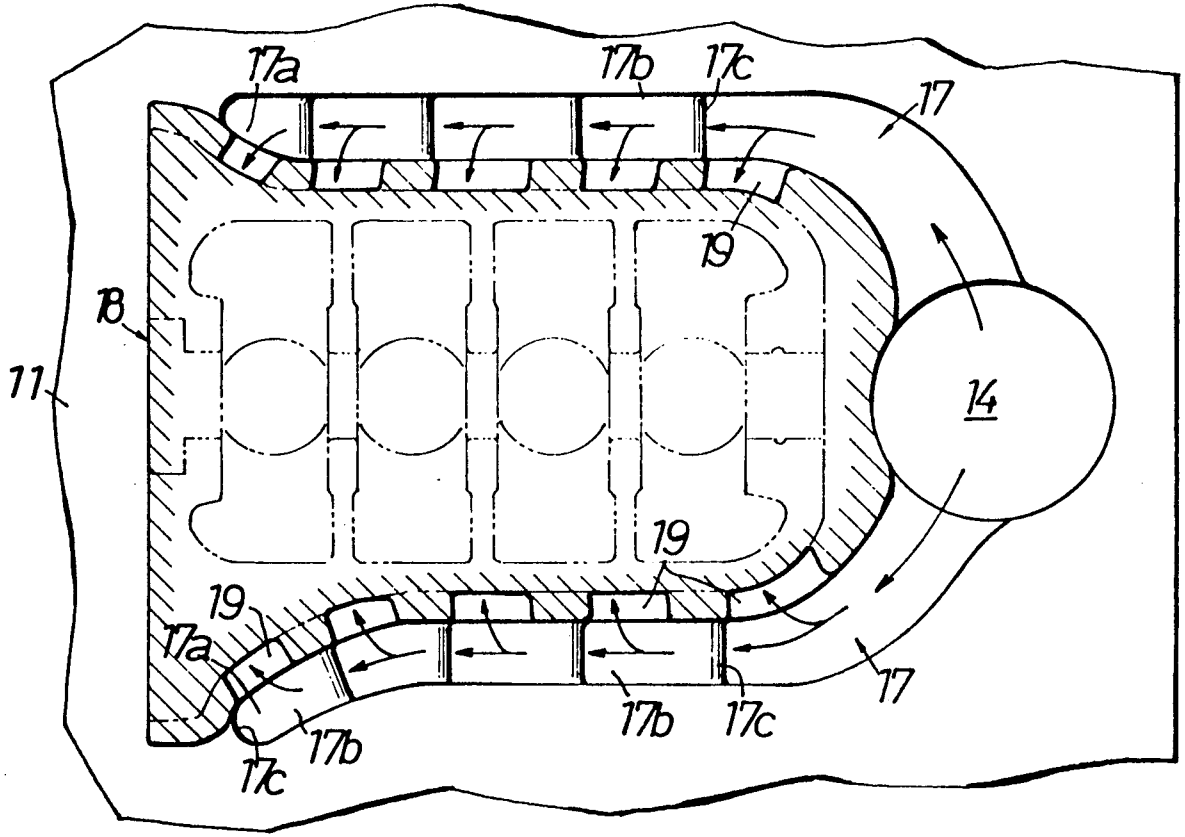
FIG. 9 is a sectional view taken along line IX—IX in FIG. 8.

As shown in FIGS. 8 and 9, the lower die 11 includes a basin 14 for receiving a molten metal of aluminium alloy from a furnace (not shown), a pouring cylinder 15 communicating with the basin 14, a plunger 16 slidably fitted in the pouring cylinder 15, and a pair of runners 17 bifurcated from the basin 14 to extend in the direction of the cylinder barrels. The lower die 11 also has a molding block 18 projecting upwardly between both of the runners 17, and the molding block 18 defines a second cavity C2 for molding the crankcase 5 in cooperation with both the side dies $10_1$ and $10_2$. The cavity C2 is in communication at its upper end with the first cavity C1 and at its lower end with both the runners 17 through a plurality of gates 19.

The molding block 18 is comprised of four first taller semicolumnar molding portions $18_1$ formed at predetermined intervals, and second protruded molding portions $18_2$ located between the adjacent first molding portions $18_1$ and outside both of the outermost first molding portions $18_1$. Each first molding portion $18_1$ is used for molding a space 20 (see FIGS. 2 and 3) in which a crankpin and a crankarm are rotated, and each second molding portion $18_2$ is employed to mold a crank journal bearing holder 21 (see FIGS. 2 and 3). Each gate 19 is provided to correspond to each the second molding portions $18_2$ and designed to permit the charging or pouring of a molten metal in larger volume portion of the second cavity C2 in a early stage.

Both the runners 17 are defined with their bottom surfaces stepped in several ascending stairs to stepwise decrease in sectional area from the basin 14 toward runner extensions 17*a*. Each raised portion 17*c* connected to each of the stepped portion 17*b* is angularly formed to be able to smoothly guide molten metal into each the gates 19.

With the sectional area of the runner 17 decreasing stepwise in this manner, a larger amount of molten metal can be charged or poured, at the portion larger in sectional area, into the second cavity C2 through the gate 19 at a slower speed, and at the portion smaller in sectional area, into the second cavity through the gate 19 at a faster speed, so that the moten metal level in the cavity C2 rises substantially equally over the entire length of the cavity C2 from the lower ends on the opposite sides thereof. Therefore, the molten metal can not produce any turbulent flow and thus, a gas such as air can be prevented from being included into the molten metal to avoid the generation of mold cavities. In addition, a molten metal pouring operation is effectively conducted, leading to an improved casting efficiency.

Figure 6:
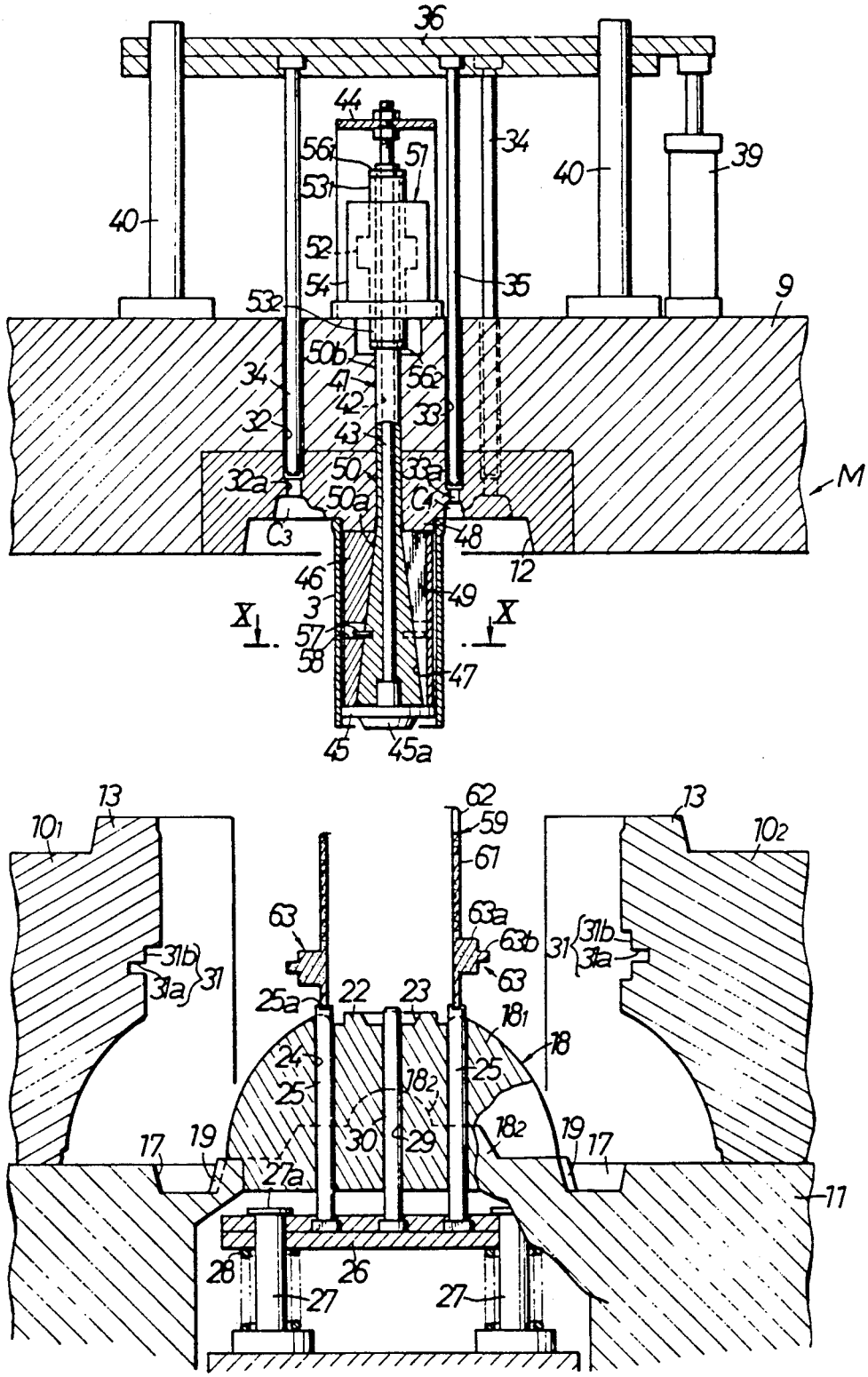
FIG. 6 is a front view in vertical section of the casting apparatus with the mold open.

As shown in FIGS. 6 and 7, a locating projection 22 is provided on the top of each of the first molding portions $18_1$ and adapted to be fitted in the circumferential surface of the sleeve 3 of cast iron, and a recess 23 is defined at the central portion of the locating projection 22. A through hole 24 is made in each of two first molding portions $18_1$ located on the opposite sides to penetrate the first molding portion $18_1$ on each of the opposite sides of the locating projection 22. A pair of temporarily placed pins 25 are slidably fitted in the through holes 24, respectively, and are used to the water-jacket molding sand core 59. The lower ends of the temporarily placing pins 25 are fixed on a mounting plate 26 disposed below the molding block 18. Two support rods 27 are inserted through the mounting plate 26, and a coil spring 28 is provided in compression between the lower portion of each the support rods 27 and the lwoer surface of the mounting plate 26. During opening the mold, the mounting plate 26 is subjected to the resilient force of each the coil springs 28 to move up until it abuts against the stopper 27*a* on the fore end of the support rods 27. This causes the fore end of the pins 25 protrude from the top surface of the first molding portion $18_1$. A recess 25*a* is made in the fore end of each of the pins 25 and adapted to be engaged by the lower edge of the sand core.

A through hole 29 is made between the two first molding portions $18_1$ located on the opposite sides at the middle between both the through holes 24, and an operating pin 30 is slidably fitted in the through hole 29. The lower end of the operating pin 30 is fixed to the mounting plate 26. During opening of the mold, the fore end of the operating pin 30 is protrudes into the recess 23, and during closing of the mold, it is pushed down by an expanding mechanism 41, thereby retracting the pins 25 from the top surfaces of the first molding portions $18_1$.

A core bedding recess 31 for the sand core 59 is provided at two places: namely in the central portions of those walls of the first and second side dies $10_1$ and $10_2$ defining the second cavity C2. Of the core bedding recesses 31 consists of an engaging bore 31*a* in which the sand core is positioned, and a clamp surface 31*b* formed around the outer periphery of the opening of the engaging bore 31*a* for clamping the sand core.

And the clamping recess 12 of the upper die 9 are a plurality of third cavities C3 opened into the first cavity C1 to permit the overflow of a molten metal and plurality of fourth cavities C4 for shaping the communication holes 7. The upper die 9 also has gas vent holes 32 and 33 therein which are communicated with each of the third cavities C3 and of the fourth cavities C4, respectively.

Closing pins 34 and 35 are inserted into the gas vent holes 32 and 33, respectively, and are fixed at their upper ends to a mounting plate 36 disposed above the upper die 9.

The gas vent holes 32 and 33 have smaller diameter portions 32*a* and 33*a*, respectively, which extend upwardly a predetermined length from the respective ends of the gas vent holes 32 and 33, communicating with the cavities C3 and C4, and which are fitted with the corresponding closing pins 34 and 35 so that the third and fourth cavities C3 and C4 may be closed.

A hydraulic cylinder 39 is disposed between the upper surface of the upper die 9 and the mounting plate 36 and operates to move the mounting plate 36 upwardly or downwardly, thereby causing the individual closing pins 34 and 35 to close the corresponding smaller diameter portions 32*a* and 33*a*. It is to be noted that the reference numeral 40 designates a rod for guiding the mounting plate 36.

The expanding mechanism 41, which is provided in the upper die 9 for applying an expansion force to the sleeve 3 cast in each the cylinder barrels $1_1$ to $1_4$, is constituted in the following manner.

A through hole 42 is made in the upper die 9 with its center line aligned with the extension of the axis of the operating pin 30, and a support rod 43 is loosely inserted into the through hole 42. The support rod 43 is fixed at its upper end to a bracket 44 above the upper surface of the upper die 9, and it has, as a sealing member, a plate 45 secured at its lower end for blocking the entry of molten metal. The blocking plate 45 is formed at its lower surface with a projection 45*a* which is fittable in the recess 23 at the top of the first molding portion $18_1$.

Figure 10:
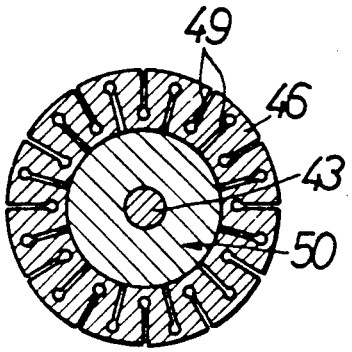
FIG. 10 is a sectional view taken along line X—X in FIG. 6.

The hollow expansion shell 46 has a circular outer peripheral surface and a tapered hole 47 having a downward slope from the upper portion toward the lower portion. The lower portion of the support rod 43 projecting downwardly from the upper die 9 is loosely inserted into the tapered hole 47 of the expansion shell 46 whose upper end surface bears against a projection 48 disposed as a sealing member on the recess 12 of the upper die 9 and whose lower end surface is carried on the blocking plate 45. As shown in FIG. 10, a plurality of slit grooves 49 are made in the peripheral wall of the expansion shell 46 at circumferentially equal intervals to radially extend alternately from the inner and the outer peripheral surfaces of the expansion shell 46.

A hollow operating or actuating rod 50 is slidably fitted on the support rod 43 substantially over its entire length for expanding the expansion shell 46, and is comprised of a frustoconical portion 50*a* adapted to be fitted in the tapered hole 47 of the expansion shell 46, and a truly circular portion 50*b* continuously connected to the frastoconical portion 50*a* so as to be slidably fitted in the through hole 42 and protruded from the upper die 9. A plurality of pins 57 are protrude from the frustoconical portion 50*a* and each is inserted into a vertically long pin hole 58 of the expansion shell 46 to prevent the expansion shell 46 from being rotated while permitting the vertical movement of the frustoconical portion 50*a*.

A hydraulic cylinder 51 is fixedly mounted on the upper surface of the upper die 9 and contains a hollow piston 52 therein. Hollow piston rods $53_1$ and $53_2$ are mounted on the upper and lower end surfaces of the hollow piston 52 and project therefrom to penetrate the upper and lower end walls of a cylinder body 54, respectively. The truly circular portion 50*b* of the operating rod 50 is inserted into a hole 1 through the hollow piston 52 and the hollow piston rods $53_1$ and $53_2$, and antislip-off stoppers $56_1$ and $56_2$ each fitted in an annular groove of the truly circualr portion 50*b* are mounted to bear against the upper end surface of the hollow piston rod $53_1$ and the lower end surface of the hollow piston rod $53_2$, respectively, so that the hollow piston 52 causes the operating rod 50 to be moved up or down. The four expanding mechanisms 41 may be provided to correspond to the individual cylinder barrels $1_1$ to $1_4$ of the cylinder block S, respectively.

Figure 11:
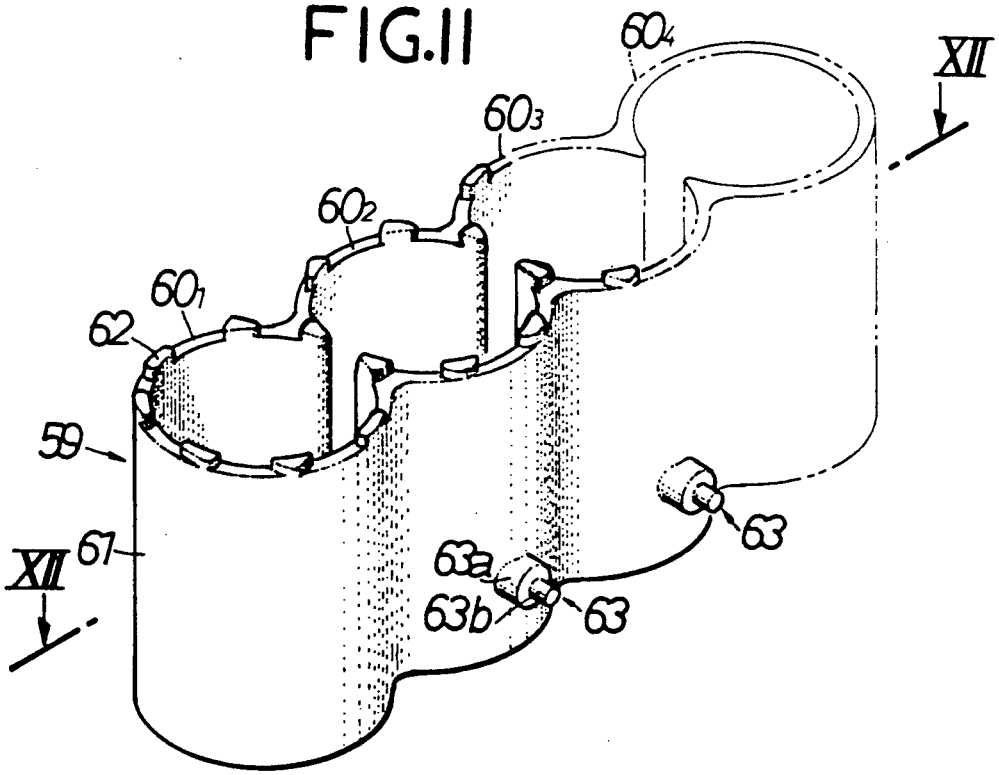
FIG. 11 is a perspective view of a sand core from above.
Figure 12:
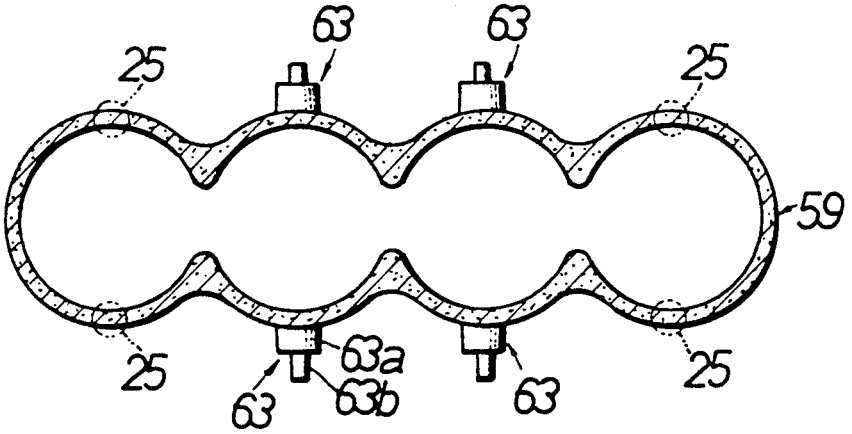
FIG. 12 is a sectional view taken along line XII—XII in FIG. 11.

FIGS. 11 and 12 show the water-jacket molding sand core 59 which is constituted of a core body 61 comprising four cylindrical portions $60_1$ to $60_4$ corresponding to the four cylinder barrels $1_1$ to $1_4$ of the cylinder block S with the peripheral interconnecting walls of the adjacent cylindrical portions being eliminated, a plurality of projections 62 formed on the end surface of the core body 61 on the cylinder head binding side to define the communication ports 7 for permitting the communication of the water jackets 6 with the water jackets of the cylinder head, and a core print 63 protrudedly provided on the opposite (in the direction of the cylinder barrels) outer side surfaces of the core body 61, e.g., on the opposite outer side surfaces of two cylindrical portions $60_2$ and $60_3$ located between the outermost ones in the illustrated embodiment. Each the core prints 63 is formed of a larger diameter portion 63*a* integral with the core body 61, and a smaller diameter portion 63*b* on the end surface of the larger diameter portion 63*a*. In this case, the projection 62 is sized to be loosely fitted in the aforesaid fourth cavity C4. The sand core 59 is formed, for example, of a resin-coated sand.

Description will now be made of an operation of casting a cylinder block blank Sm in the above casting apparatus.

First, as shown in FIG. 6, the upper die 9 is moved up and both the side dies $10_1$ and $10_2$ are moved away from each other, thus causing the opening of the mold. In the expanding mechanism 41, each hydraulic cylinder 51 is operated to cause the hollow piston 52 to move the operating rod 50 downwardly, so that the downward movement of the frustoconical portion 50*a* allows the expansion shell 46 to be contracted. In addition, the hydraulic cylinder 39 of the upper die 9 is operated to move the mounting plate 36 upwardly. This causes the individual closing pins 34 and 35 to be released from the corresponding smaller diameter portions 32*a* and 33*a* respectively communicating with the third and fourth cavities C3 and C4. Further, the plunger 16 in the pouring cylinder 15 is moved downwardly.

The substantially truly circular and highly rigid sleeve 3 of cast iron having a thickness as large as 8 mm is loosely fitted in the each expansion shell 46, and the opening at the upper end of the sleeve 3 is fitted and closed by projection 48 of the upper die 9. The end surface of the sleeve 3 is aligned with the lower end surface of the projection 45*a* on the blocking plate 45, while the opening at the lower end of the sleeve 3 is closed by the blocking plate 45. The hydraulic cylinder 51 of the expanding mechanism 41 is operated to cause the hollow piston 52 therein to lift the operating rod 50. The frustoconical portion 50*a* is thereby moved upwardly, so that the expansion shell 46 is expanded. Thereupon, the sleeve 3 is subjected to an expansion force and thus reliably held on the expansion shell 46.

As shown in FIGS. 6 and 12, the lower edges of the cylindrical portions $60_1$ and $60_4$ on the outermost opposite sides in the sand core 59 are each engaged in the recess 25*a* of the each temporarily placing pin 25 projecting from the top of each of the first molding portions $18_1$ on the opposite sides in the lower die 11, thereby temporarily placing the sand core 59.

The side dies $10_1$ and $10_2$ are moved a predetermined distance toward each other to engage each core bedding recess 31 with each core print 63, thus really placing the sand core 59. More specifically, the smaller diameter 63*b* of each of the core prints 63 in the sand core 59 is fitted into the engaging hole 31*a* of each of the core bedding recesses 31 to position the sand core 59, with the end surface of each of the larger diameter portions 63*a* a parallel to the direction of the cylinder barrels, being mated with the clamping surface 31*b* of each core bedding recess 31 to clamp the sand core 59 by the clamping surface 31*b*.

As shown in FIG. 7, the upper die 9 is moved downwardly to insert each of the sleeves 3 into each of the cylindrical portions $60_1$ to $60_4$ of the sand core 59, and the projection 45a of the molten metal-entering blocking plate 45 is fitted into the recess 23 at the top of the first molding portion $18_1$. This causes the projection 45a of the blocking plate 45 to push down the operating rod 30, so that each of the pins 25 is moved down and retracted from the top surface of the first molding portion $18_1$. In addition, the clamping recesses 12 of the upper die 9 are fitted with the clamping projections 13 of both the side dies $10_1$ and $10_2$, thus effecting the clamping of the mold. This downward movement of the upper die 9 causes the projection 62 of the sand core 59 to be loosely inserted into the fourth cavity C4, whereby a space is defined around the projection 62. A space 70 for shaping the reinforcing deck portion 8 is also defined between the end surface of the sand core 59 and the inner surface of the recess 12 opposed to such end surface.

A molten metal of aluminum alloy is supplied out of a furnace into the basin 14 of the lower die 11, and the plunger 16 is moved up to pass the molten metal through both the runners 17 and pour it into the second cavities C2 and the first cavities C1 from the opposite lower edges of the second cavities C2 via the gates 19. The application of this bottom pouring process allows a gas such as air in both the cavities C1 and C2 to be forced up by the molten metal and vented upwardly from the upper die 9 via the gas vent holes 32 and 33 in communication with the third and fourth cavities C3 and C4.

In the present case, both the runners 17 have the runner bottom stepped in several upward stairs from the basin 14 so that the sectional area may decrease stepwise toward the runner extensions 17a as described above and hence, the upward movement of the plunger 16 causes a molten metal to be passed from both the runners 17 through the gates 19 and to smoothly rised in the second cavities C2 substantially uniformly over the entire length thereof from the opposite side lower ends thereof. Thus, the molten metal can not produce a turbulent flow in both the cavities C1 and C2, and a gas such as air can be prevented from being included into the molten metal to avoid the generation of any mold cavities.

After the molten metal has been poured in the third and fourth cavities C3 and C4, the hydraulic cylinder 39 on the upper die 9 is operated to move the mounting plate down, thereby causing the closing pins 34 and 35 to close the smaller diameter portions 32a and 33a communicating with the cavities C3 and C4, respectively.

Figure 13:
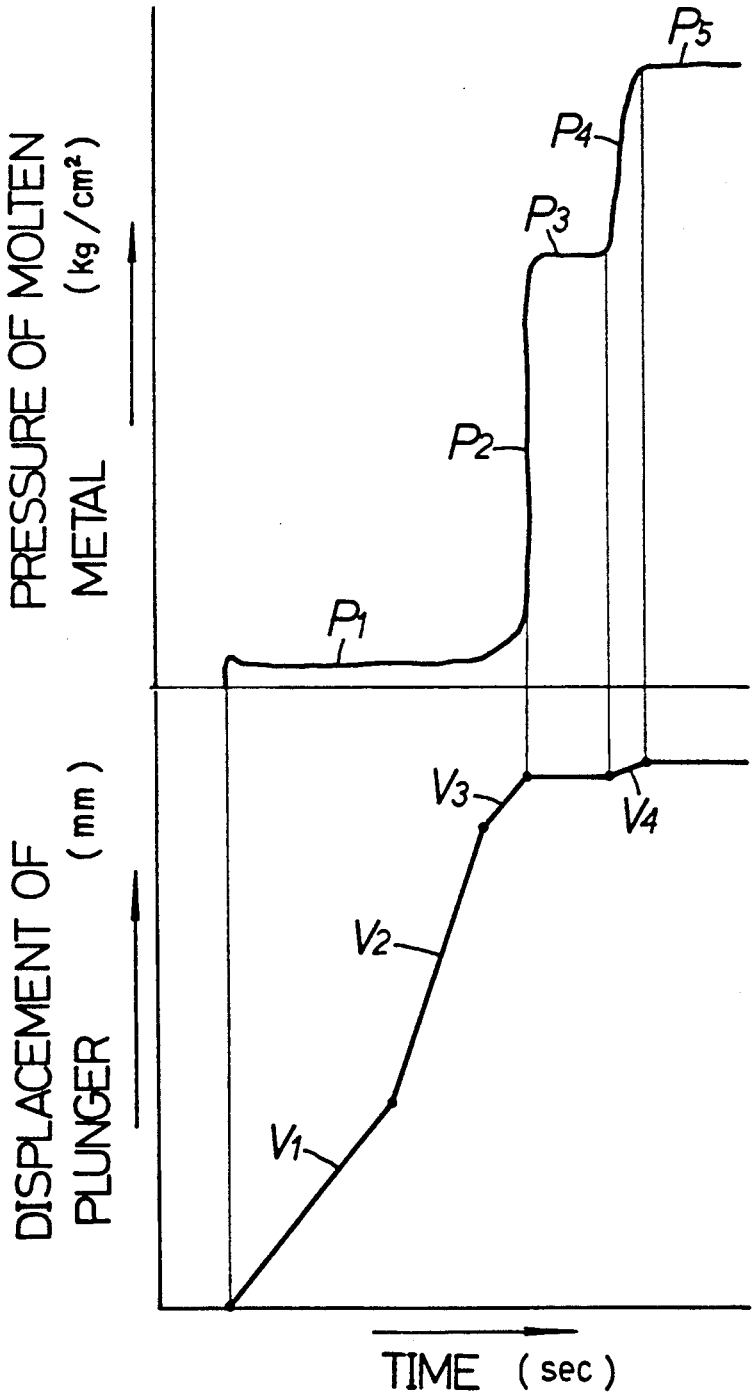
FIG. 13 is a graph representing the relationship between time and displacement of plunger and the relationship between time and pressure of molten metal.

In the above pouring operation, the displacement of the plunger 16 for pouring the molten metal into the second and first cavities C2 and C1 and the pressure of the molten metal are controlled as shown in FIG. 13.

More specifically, the speed of plunger 16 is controlled at three stages of first to third velocities V1 to V3. In the present embodiment, the first velocity V1 is set at 0.08–0.12 m/sec., the second V2 is at 0.14–0.18 m/sec., and the third velocity V3 is at 0.04–0.08 m/sec. to give a substantial deceleration. This control in velocity at three stages prevents the waving of the molten metal and produces a calm molten metal flow which can not include a gas such as air thereinto, so that the molten metal can be poured into both the cavities C2 and C1 with a good efficiency.

At the first velocity V1 of the plunger 16, the molten metal merely fills both the runners 17 and hence, the pressure P1 of the molten metal is kept substantially constant. At the second and third velocities V2 and V3 of the plunger 16, the molten metal is poured or charged into both the cavities C1 and C2 and therefore, the pressure P2 of the molten metal rapidly increases. After the plunger 16 has been moved at the third velocity V3 for a predetermined period of time, the pressure P3 of the molten metal is maintained at 150–400 kg/cm$^2$ for a period of about 1.5 seconds, whereby the sand core 59 is completely enveloped in the molten metal to form a solidified film of molten metal on the surface thereof.

After the above time has elapsed, the plunger 16 is deceleratively moved at the velocity V4, so that the pressure P4 of the molten metal increases. When the pressure has reached a level P5 of 200–600 kg/cm$^2$, the movement of the plunger 16 is stopped, and under this condition, the molten metal is solidified.

If the pressure of the molten metal is kept constant for a predetermined period of time to form the solidified film of molten metal on the surface of the sand core 59 as described above, the sand core 59 can be protected by the film against breaking. In addition, the sand core 59 is expanded due to the molten metal, but because the projection 62 is loosely inserted in the fourth cavity C4, it follows the expansion of the sand core 59, whereby the folding of the projection 62 is avoided.

Since the sand core 59 is clamped in an accurate position by both the side dies $10_1$ and $10_2$ through each the core prints 63, it can not float up during pouring the molten metal into the first cavities C1 and during pressing the molten metal in the cavities C1. In addition, since the end surface of the larger diameter portion 63a of each core print 63 mates with the clamping surface 31b, as the sand core 59 is being expanded, the deforming force thereof is suppressed by of the clamping surfaces 31b to prevent the deformation of the sand core 59. Thus, a siamese-type cylinder barrel 1 is provided having a uniform thickness around each of the sleeves 3.

As discussed above, a closed deck-type cylinder block blank can be cast with substantially the same production efficiency as in a die casting process, by controlling the speed of plunger 16 and the pressure of the molten metal.

After the completion of solidification of the molten metal, the hydraulic cylinder 51 of the expanding mechanism 41 is operated to move the operating rod 50 down, thereby eliminating the expansion force of the exapansion shell 46 on the sleeve 3. The mold is opened to yield a cylinder block blank Sm as shown in FIG. 5.

In this cylinder block blank Sm, the influence of the casting strain in each the cylinder barrels $1_1$ to $1_4$ on each sleeve 3 is small, because each sleeve 3 is thick and highly rigid.

Then, the cylinder block blank Sm is subjected to a thermal treatment for a period of 3 hours at a temperature of 220° C. to reduce the casting strain produced in of the cylinder barrels $1_1$ to $1_4$.

Thereafter, the protruded portions 64 (FIG. 5) each including the projection 62 of the sand core 59 are cut away from the cylinder block blank Sm, so that the communication ports 7 are consequently defined at the portions corresponding to the projections 62 and the reinforcing deck portions 8 are each also formed between the adjacent communication ports 7. Subsequently, the sand extraction is effected to define the water jacket 6, and the inner peripheral surface of each sleeve 3 is worked into a true circle to finish it to a thickness of 5 mm and further, another predetermined operation is conducted to produce a cylinder block S as shown in FIGS. 1 to 4.

Figure 14:
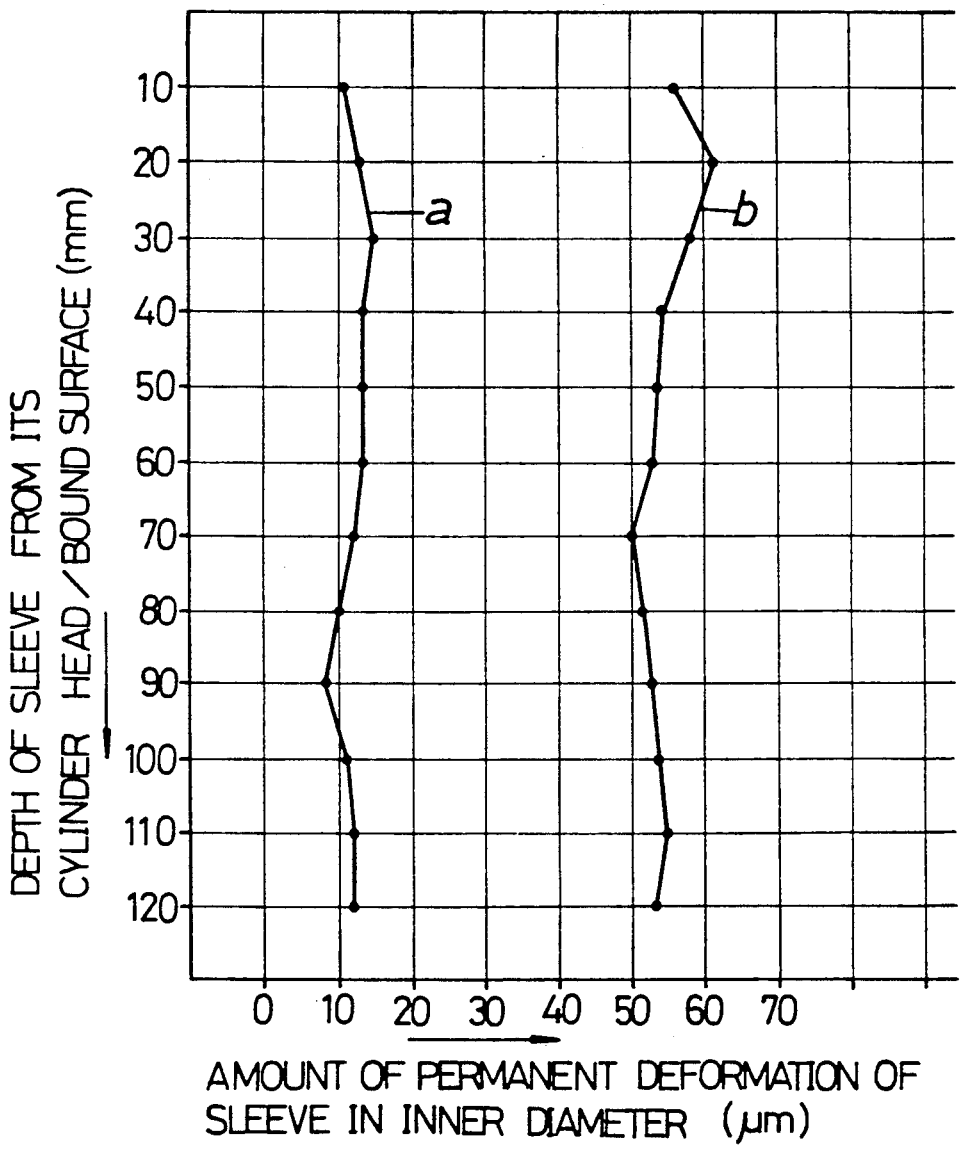
FIG. 14 is a graph illustrating the relationship between the depth of sleeve from its cylinder head-bound surface and the amount of sleeve permanently deformed at in inner diameter.

In FIG. 14, the line a represents the results of measurements obtained by heating the whole of the above obtained cylinder block S for the period of one hour at a temperature reached during operation of an engine, i.e., at 200° C. and determining the amount of permanent deformation inner diameter of the sleeve at an ambient temperature. The line b represents the results of measurements obtained in the same manner with the cylinder block produced in the comparative example from the cylinder block blank as cast without the thermal treatment.

As apparent from FIG. 14, in the cylinder block in the comparative example, the amount of permanent deformation of the inner diameter of the sleeve exhibits a maximum value of 61 μm at the depth of the sleeve of 20 mm from its cylinder head-bound surface, while in the cylinder block S obtained according to the present invention, the amount of sleeve permanently deformed inner diameter of the sleeve exhibits a maximum value of 15 μm at the depth of the sleeve of 30 mm from its cylinder head-bound surface c. This means that the thermal treatment of the cylinder block blank Sm after casting enables the amount of permanent deformation of the sleeve at its inner diameter to be substantially reduced.

It is to be noted that if the thickness of sleeve 3 is less than 10% of its inner diameter, rigidity of the sleeve 3 is reduced, so that the casting strain in each the cylinder barrels $1_1$ to $1_4$ may influence each sleeve 3 to produce a strain in the sleeve 3. Therefore, a thickness less than 10% of the inner diameter is not preferred.

In the above casting operation, if the sleeves 3 are castingly incorporated in a state previously heated to a temperature of 150° to 700° C., the casting stress remaining in the sleeve 3 can be substantially uniform around the circumference of the sleeve 3, and a good close adhesion can be ensured between of sleeve 3 and each the cylinder barrels $1_1$ to $1_4$.

Figure 15A:
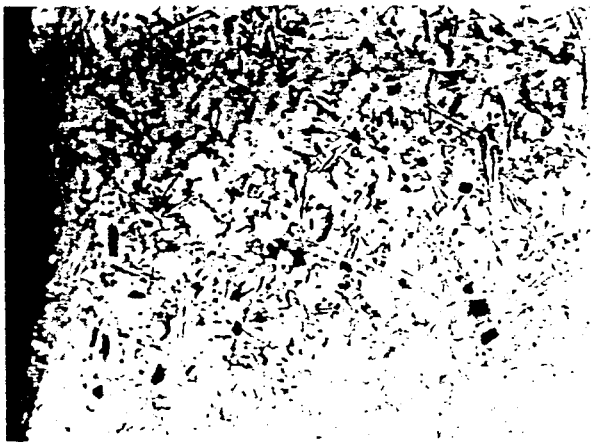
FIGS. 15A to 15C are micrographs showing the metal structure of the cylinder barrel in the siamese-type cylinder block obtained according to the preset invention, respectively.
Figure 15B:
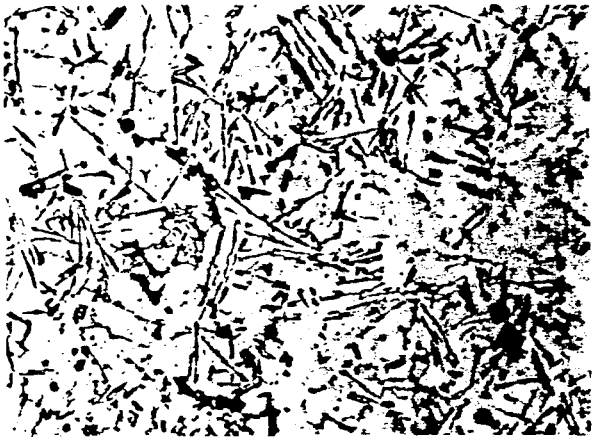
Figure 15C:
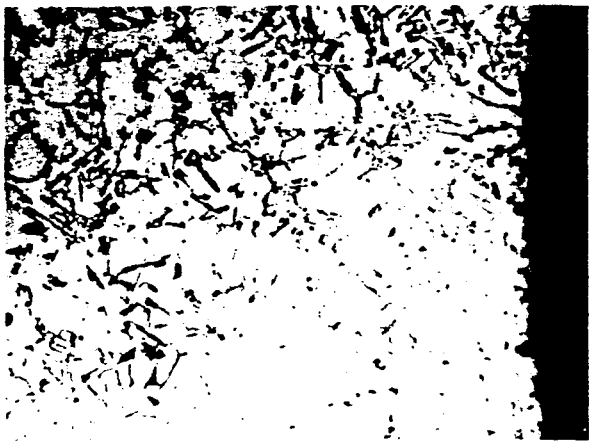

FIGS. 15A, 15B and 15C show the metal structure of the aluminum alloy in micrographs (200 times) of the cylinder barrels $1_1$ to $1_4$ in the cylinder block S produced in the process of the present invention, i.e., by previously heating the sleeves 3 to a temperature of 250° to 500° C. and casting-in the sleeves, respectively, at the portion close to the sleeves 3 (in FIG. 15A), the central portion (in FIG. 15B) and the portion close to the sand core 59 (in FIG. 15C). As apparent from these Figures, in the cylinder barrels $1_1$ to $1_4$, the metal structures are substantially identical with one another at the portion close to the sleeves 3, at the central portion and at the portion close to the sand core 59. This is because the heating of the sleeves 3 to a temperature of 250° to 500° C. followed by the casting-in thereof permits the speed of the molten metal solidified to be substantially uniform around the sleeve 3. The metal structure at the portion between the adjacent sleeves 3 is substantially identical with that shown in FIG. 15A. Also due to the fact that the shrinkage of the sleeve 3 follows the solidification shrinkage of the molten metal, the casting stress remaining in the sleeve 3 is substantially uniform around the circumference of the sleeve 3.

Figure 16A:
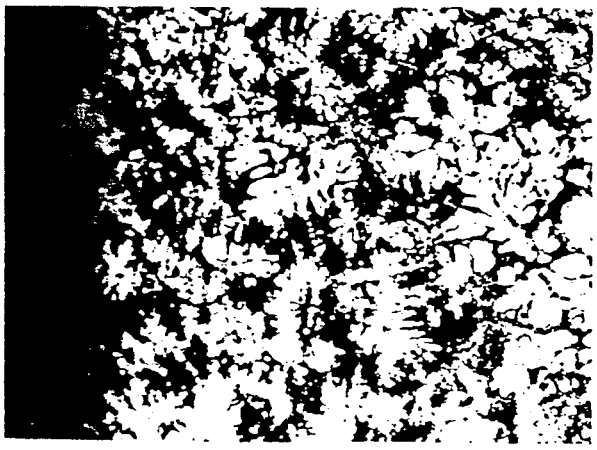
FIGS. 16A to 16C are micrographs showing the metal structure of the cylinder barrel in the siamese-type cylinder block in the comparative example, respectively.
Figure 16B:
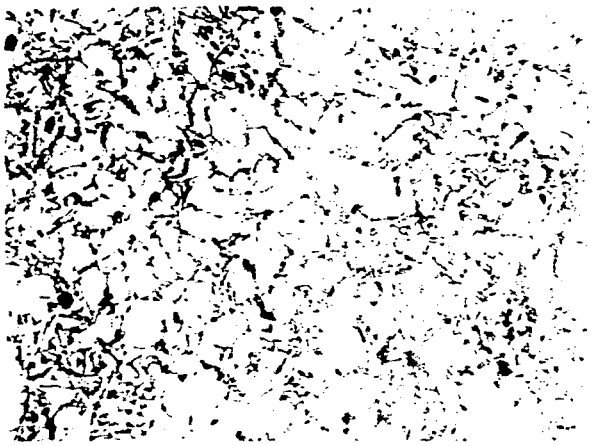
Figure 16C:
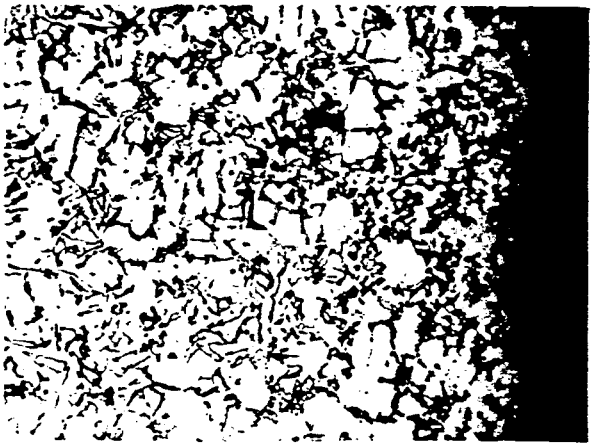

FIGS. 16A, 16B and 16C show the metal structure of the aluminum alloy in the micrographs (200 times) of the cylinder barrels in the cylinder block obtained in the comparative example from the incorporation of the sleeves in the cylinder barrels at an ambient temperature and corresponding to FIGS. 15A, 15B and 15C, respectively. As apparent from these Figures, the use of the sleeves at an ambient temperature results in different metal structures at the portion close to the sleeves, the central portion and the portion close to the core, and in substantially the same metal structure at the portion between the adjacent sleeves as that shown in FIG. 16A. In addition, the shrinkage of the sleeve may not follow the solidification shrinkage of the molten metal and consequently, the casting stress remaining in the sleeve may be non-uniform around its circumference.

Figure 17:
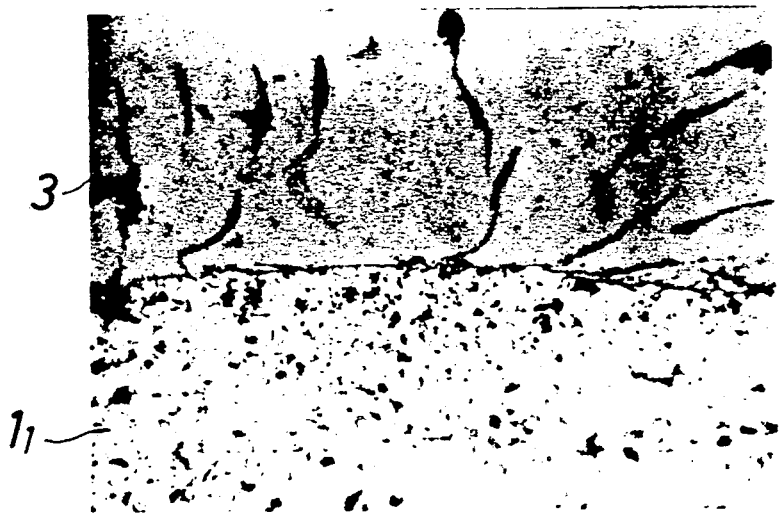
FIG. 17 is a micrograph showing the metal structure of the deposited portion between the cylinder barrel and the sleeve in the siamese-type cylinder block obtained according to the present invention.

FIG. 17 shows the metal structure of the cast iron and the aluminum alloy in the micrograph (400 times) of the deposited portion between the sleeve 3 and cylinder barrel $1_1$ in the cylinder block S produced according to the present invention. It can be seen in this Figure that the adhesion between the cast iron and the aluminum alloy is good at the interface, namely the deposited portion between the sleeve 3 and the cylinder barrel $1_1$ and no clearance is produced between them. This results in a good release from heat of the sleeve 3.

Figure 18:
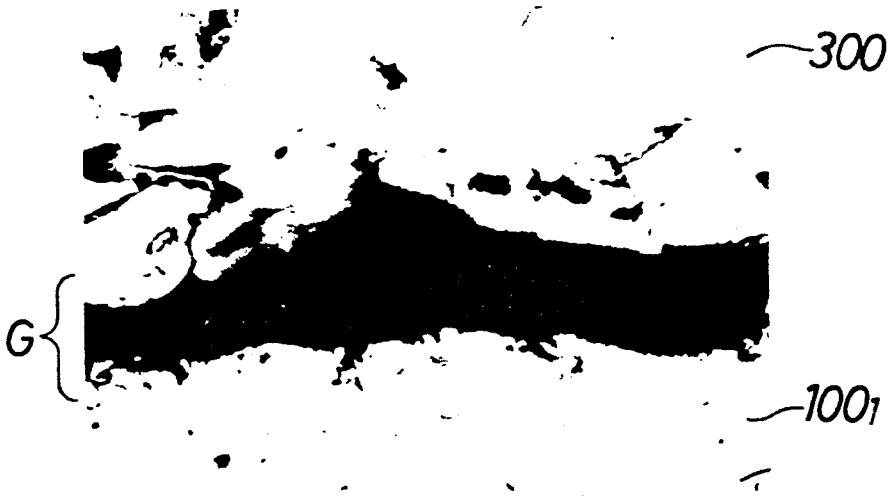
FIG. 18 is a micrograph showing the metal structure of the deposited portion between the cylinder barrel and the sleeve in the siamese-type cylinder block in the comparative example.

FIG. 18 shows the metal structure of the cast iron and the aluminum alloy in the micrograph (400 times) of the deposited portion between the sleeve 300 and the cylinder barrel $100_1$ in the cylinder block obtained from the incorporation of the sleeve at an ambient temperature. It can be seen in this Figure that the adhesion between the casting iron and the aluminum alloy is inferior at the interface, namely the deposited portion between the sleeve 300 and the cylinder barrel $100_1$ and a very small clearance G is produced between them. As a result, the release of heat from the sleeve 300 is inferior.

In the cylinder block S produced according to the present invention, the casting stress remaining in the sleeve 3 is substantially uniform around its circumference and the release of heat of the sleeve 3 is good. Therefore, when an engine assembled using this cylinder block is operated, the amount of each sleeve thermally expanded is substantially uniform around its circumference.

After removing each protruded portion 64 formed in cooperation of each fourth cavity C4 and each projection 62 of the sand core 59 in the cylinder block blank Sm as shown in FIG. 5 to make each communication port 7 and each reinforcing deck portion 8, the cylinder block blank Sm is subjected to sand extraction and to annealing in a manner described hereinbelow, thus making it possible to economically provide a high performance cylinder block S.

First, ths sand core 59 is roughly broken from the communication port 7 and the opening 75 made from each core print 63 of the sand core 59 in the cylinder block blank Sm using achisel, punch, drill or the like, and vibration is then applied to the cylinder block blank Sm to promote the breaking of the sand core 59, followed by the extraction of the sand from the blank Sm. In this case, the vibration causes the breaking of the sand core 59 to proceed and hence, approximately 90% of the sand core 59 is removed from the cylinder block blank Sm.

Further, utilizing the aforesaid communication port 7 and opening 75, the inside of the cylinder block blank Sm is subjected to a shot blasting or sandblasting treatment to completely remove the sand core 59 from the blank Sm, thus producing the water jacket 6.

The cylinder block blank Sm having the sand core 59 thus removed therefrom is subjected to annealing, i.e., a thermal treatment of heating the blank Sm to a temperature of 220° C. for a period of 3.5 hours for strain relief.

The resulting cylinder block blank Sm is subjected to cleaning and checking, followed by machining such as a working into true circle for each sleeve 3 to provide a cylinder block S as shown in FIGS. 1 to 4.

Figure 19A:
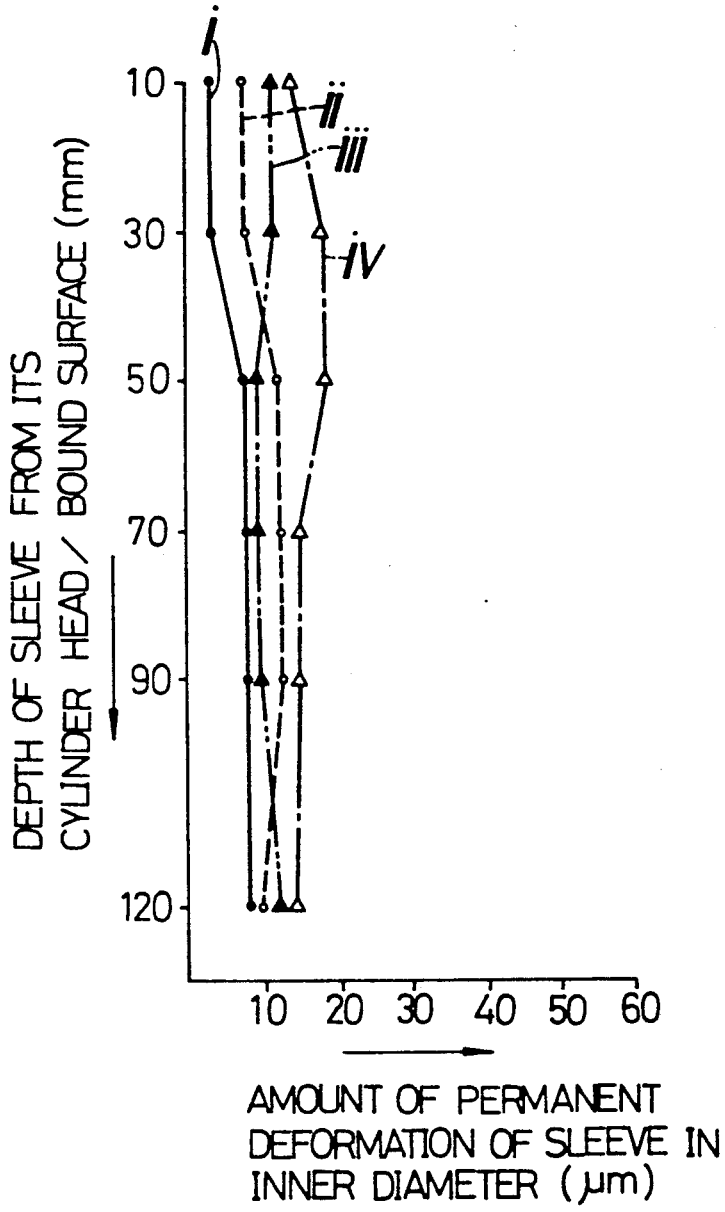
FIG. 19A is a graph illustrating the relationship between the depth of sleeve from its cylinder head-bound surface and the amount of sleeve permanently deformed in inner diameter in the siamese-type cylinder block obtained according to the present invention.
Figure 19B:
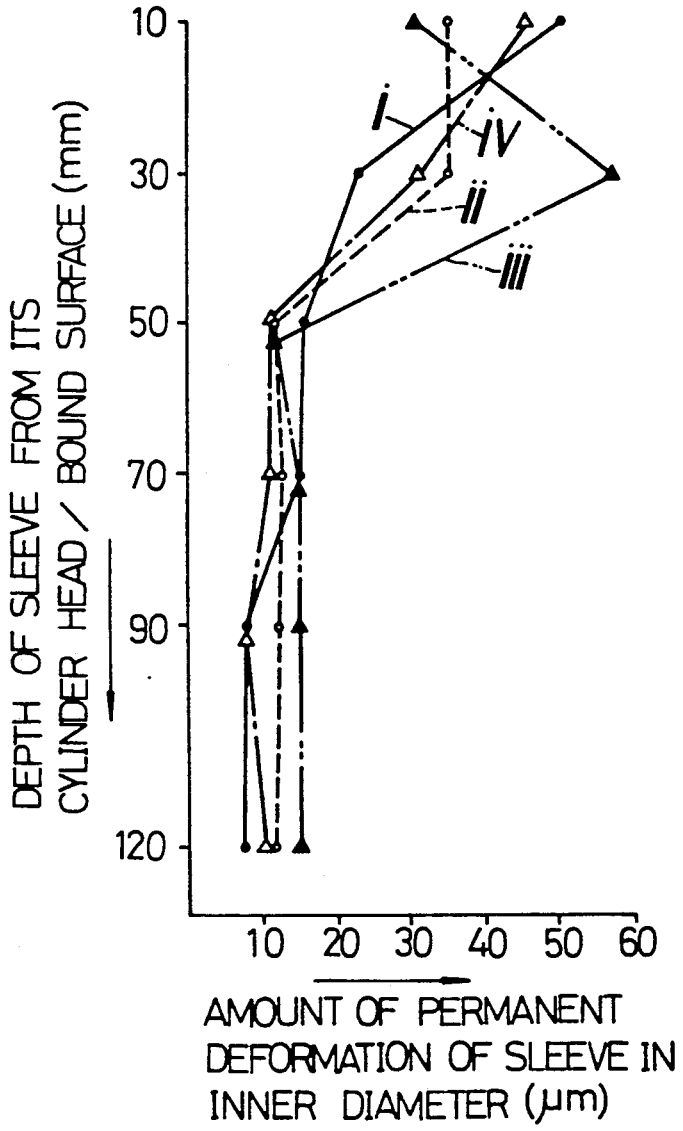
FIG. 19B is a graph illustrating the relationship between the depth of sleeve from its cylinder head-bound surface and the amount of sleeve permanently deformed in inner diameter in the siamese-type cylinder block in the comparative example.

FIG. 19A illustrates the results of the measurements for the amount of permanent deformation of the inner diameter of a sleeve at an ambient temperature, when the above cylinder block S as a whole is heated to the temperature reached during the operation of an engine of 200° for a period of 1.5 hours, and FIG. 19B illustrates the results of the similar measurements in the case of the cylinder block obtained in the comparative example from the conventional method, i.e., the procedure including the heating treatment for the removal of the sand core, the T6 treatment and the like.

In FIG. 19A, the lines i to iv represent the results of the measurement of the sleeves 3 in the four cylinder barrels $1_1$ to $1_4$, respectively.

As can be seen in FIG. 19A, the amount of permanent deformation of sleeve in inner diameter of the sleeve in the cylinder block S produced according to the present invention is of a maximum value of 20 μm at a depth of 30 to 50 mm from the cylinder head-bound surface c, and in this way, the amount of sleeve permanently deformed is substantially reduced and also less distributed in the above range of depth. This is attributable to the fact that the removal of the sand core 59 at an ambient temperature cases non-uniform stress not to remain in each sleeve 3.

On the other hand, as can be seen in FIG. 19B, the amount of permanent deformation of the inner diamter of the sleeve in in the cylinder block in the comparative example exhibits a maximum value of 55 μm at a sleeve depth of 30 mm from the cylinder head-bound surface of the sleeve, and the amount of permanent deformation the sleeve is largely distributed over the regions in a range of depth of 10 to 50 mm which are at an increased temperature during the operation of the engine. This is due to the fact that the T6 treatment causes non-uniform stress to remain in each sleeve.

Figure 20:
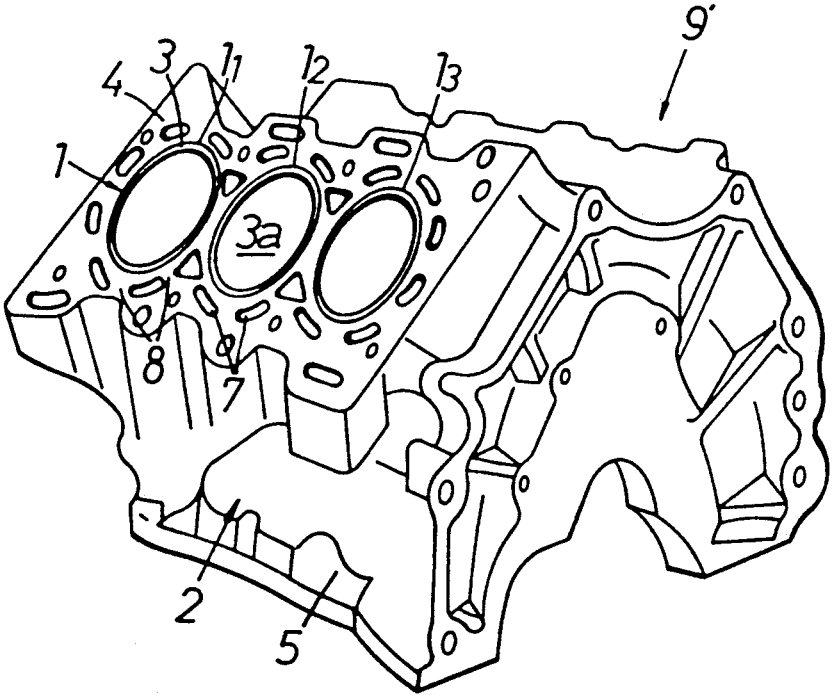
FIG. 20 is a perspective view of a V-shaped siamese-type cylinder block, viewed from above.

FIG. 20 shows a V-shaped siamese-type cylinder block S' including two siamese-type cylinder barrels 1. The cylinder block S' is also made by the same blank making step and machining step as described above. In this Figure, the same reference characters are used to designate the same parts as in the embodiment shown in FIG. 1.

What is claimed is:

1. A process for manufacturing a siamese-type cylinder block, comprising a blank-making step of providing a cylinder block blank made of an aluminum alloy and consisting of a plurality of adjacent cylinder barrels of siamese type arranged in series and wherein a highly rigid sleeve of cast iron is incorporated in each cylinder barrel, and a mechanical working or machining step of forming the inner peripheral surface of each said sleeve into a true circle, wherein said blank making step includes placing said highly rigid sleeves of cast iron, each having a thickness of 10% or more of the inner diameter thereof, into a siamese-type cylinder barrel molding cavity in a mold and then injecting a molten metal of said aluminum alloy under pressure into the cavity to cast said cylinder block blank, and subjecting said cylinder block blank to a thermal treatment to reduce casting strain produced in said cylinder barrels.

2. A process for manufacturing a siamese-type cylinder block according to claim 1, wherein the inner diameter of said sleeve in said blank making step is 78 mm, and the thickness thereof is 8 mm.

3. A process for manufacturing a siamese-type cylinder block according to claim 1, wherein said thermal treatment is carried out by holding said cylinder block blank at a temperature of 170° to 230° C. for a period of 2 to 10 hours.

4. A process for manufacturing a siamese-type cylinder block according to claim 3, wherein said thermal treatment is carried out by holding said cylinder block blank for a period of 3 hours at a temperature of 220° C.

5. A process for manufacturing a siamese-type cylinder block according to claim 1, wherein said cylinder block is of an in-line type.

6. A process for manufacturing a siamese-type cylinder block according to claim 1, wherein said cylinder block is V-shaped.

7. A process as claimed in claim 1 wherein each sleeve is cast in a respective barrel of the cylinder block blank said barrels are adjacent to one another and with formation of gaps around the barrels to form a water-jacket around the barrels in said block blank, the thickness of said cast iron sleeves and the casting of the cylinder block blank when taken in combination with the thermal treatment providing said sleeves with little casting strain and distortion and in tight engagement with the cast metal under uniform conditions around each sleeve.

8. A process for manufacturing a siamese-type cylinder block, comprising a blank making step of providing a cylinder block blank made of an aluminum alloy and consisting of a plurality of adjacent cylinder barrels of siamese type arranged in series and wherein a highly rigid sleeve of cast iron is incorporated in each cylinder barrel, and a mechanical working or machining step of forming the inner peripheral surface of each said sleeve into a true circle, wherein said blank making step includes heating said highly rigid sleeves of cast iron each having a thickness of 10% or more of the inner diameter thereof to a temperature of 150° to 700°, thereafter placing the heated sleeves into a siamese-type cylinder barrel molding cavity in a mold and then injecting a molten metal of said aluminum alloy under pressure into the cavity.

9. A process for manufacturing a siamese-type cylinder block according to claim 8, wherein the inner diameter of said sleeve in said blank making step is 78 mm, and the thickness thereof is 4 mm.

10. A process for manufacturing a siamese-type cylinder block according to claim 8, wherein the heating temperature said sleeve is of 250° to 500° C.

11. A process for manufacturing a siamese-type cylinder block according to claim 8, wherein said cylinder block is of an in-line type.

12. A process for manufacturing a siamese-type cylinder block according to claim 8, wherein said cylinder block is V-shaped.

13. A process for manufacturing a siamese-type cylinder block according to claim 8, wherein the heating of the sleeves is effective to reduce the influence of casting strain produced in said cylinder barrels in the course of casting the molten alloy onto the sleeves and to make any remaining casting stress in the sleeves uniform around the circumferences thereof.

14. A process for manufacturing a siamese-type cylinder block according to claim 13, wherein said temperature of heating of the sleeves is at a value to unify solidification speed of said molten metal around the sleeves.

15. A process for manufacturing a siamese-type cylinder block according to claim 13, wherein said temperature of heating of the sleeves is at a value to allow the heated sleeves to shrink after casting and follow the solidification and shrinkage of the molten metal.

16. A process as claimed in claim 8, wherein each sleeve is cast in a respective barrel of the cylinder block blank said barrels are adjacent to one another and with formation of gaps around the barrels to form a water-jacket around the barrels in said block blank, the thickness of said cast iron sleeves and the casting of the cylinder block blank when taken in combination with the thermal treatment providing said sleeves with little casting strain and distortion and in tight engagement with the cast metal under uniform conditions around each sleeve.

17. A process for manufacturing a siamese-type cylinder block, comprising a blank-making step of providing a cylinder block blank made of an aluminum alloy and consisting of a plurality of adjacent cylinder barrels of siamese type arranged in series and wherein a sleeve of cast iron is incorporated in each cylinder barrel and which includes a water jacket facing the entire periphery of said cylinder barrels, and a mechanical working or machining step of forming the inner peripheral surface of each said sleeve of said cylinder block blank into a true circle, wherein said blank-making step includes placing said sleeves of cast iron and a water-jacket shaping breakable core surrounding said sleeves in a siamese-type cylinder barrel molding cavity in a mold and then injecting a molten metal of said aluminum alloy into said cavity to cast the cylinder block blank, breaking said core at ambient temperature to remove the core from said cylinder block blank, and subjecting said cylinder block blank to an annealing treatment.

18. A process for manufacturing a siamese-type cylinder block according to claim 17, wherein said annealing treatment is carried out by holding said cylinder block blank at a temperature of 220° C. for a period of 3.5 hours.

19. A process for manufacturing a siamese-type cylinder block according to claim 17, wherein said cylinder block is of an in-line type.

20. A process for manufacturing a siamese-type cylinder block according to claim 17, wherein said cylinder block is V-shaped.

21. A process for manufacturing a siamese-type cylinder block according to claim 17, wherein said breakable core is a sand core.

22. A process for manufacturing a siamese-type cylinder block according to claim 21, wherein said sand core is shaped using a resin-coated sand.

23. A process as claimed in claim 17, wherein each sleeve is cast in a respective barrel of the cylinder block blank said barrels are adjacent to one another and with formation of gaps around the barrels to form a water-jacket around the barrels in said block blank, the thickness of said cast iron sleeves and the casting of the cylinder block blank when taken in combination with the thermal treatment providing said sleeves with little casting strain and distortion and in tight engagement with the cast metal under uniform conditions around each sleeve.

* * * * *